US006458009B1

(12) United States Patent
Chuang

(10) Patent No.: US 6,458,009 B1
(45) **Date of Patent: *Oct. 1, 2002**

(54) FISHING TOY

(76) Inventor: Chuan-Tien Chuang, No. 40, Lane 174, Da-Shing St., Tainan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/588,577

(22) Filed: Jun. 7, 2000

(51) Int. Cl.[7] ..... A63H 11/04; A63H 23/00
(52) U.S. Cl. ..... 446/315; 446/153; 446/158
(58) Field of Search ..... 446/153, 154, 446/156, 158, 368, 315, 330, 352, 353

(56) References Cited

U.S. PATENT DOCUMENTS 2,491,846 A * 12/1949 Boekenoogen et al. ..... 446/330
2,511,154 A * 6/1950 Garland ..... 446/158
2,703,469 A * 3/1955 Raizen ..... 446/153
2,909,868 A * 10/1959 Lewis ..... 446/139
2,933,315 A * 4/1960 Carr, Jr. ..... 446/158
3,077,698 A * 2/1963 Glass et al. ..... 446/158
3,835,581 A * 9/1974 Grieder ..... 446/158
4,713,037 A * 12/1987 Tong ..... 446/158
4,936,574 A * 6/1990 Lee ..... 273/447
6,022,025 A * 2/2000 Chuang ..... 273/448

* cited by examiner

*Primary Examiner*—Jacob K. Ackun, Jr.
*Assistant Examiner*—Faye Francis
(74) *Attorney, Agent, or Firm*—Dennison, Schultz & Dougherty

(57) ABSTRACT

A fishing toy comprising a fishing tool and a fishing target. A motor capable of sinking in water is installed in the fishing target. A battery seat, a bait biting actuation means, a swinging means; a movable switch triggered by absorption is installed in the bait biting actuation means for conducting the motor to drive the swinging means to swing. The swinging means is installed by a decelerating gear on a rotary shaft of the motor and a push plate driven by an eccentric wheel. The fishing target is an aquatic animal or amphibian, such as a frog, with a body and four movable limbs. A front end of each limb is connected to the push plate of the swinging means. Thereby, as the fishing target is fished on a hook of a fish rod, the limbs of the fishing target present a vivid action. Thus, the applications of the products are increased and the present invention can be used in many aquatic animals or amphibians.

1 Claim, 5 Drawing Sheets

FISHING TOY

RELATED INVENTION

U.S. Pat. No. 6,022,025 is a related invention assigned to the assignee of the present invention.

FIELD OF THE INVENTION

The present invention relates to a vivid fishing toy, which can be installed in various aquatic animals with limbs so that as it is hooked, the aquatic animal will preset vivid actions.

BACKGROUND OF THE INVENTION

The fishing toy disclosed in U.S. Pat. No. 6,022,025 having a structure describing in the specification of U.S. Pat. No. 6,022,025. However, as the fishing target disclosed in this prior art is placed in water, it is still in the water without any movement. It can not swim like a fish. When the fishing target is hooked, as the tail is pressed by a child, the motor and gear therein will be easily destroyed. Therefore, an invention, U.S. Pat. Ser. No. 09/310,179 is disclosed for improving the defects in the prior art. In the design, not only the gear of the motor is protected so that the fishing target swims in water, but also the lower jaw may open and close repeatedly. Further, as the fishing target is hooked, a struggle action is present.

However, the two prior art inventions are only suitable for aquatic animals with tails, while aquatic animals with limbs present different problems for development.

Therefore, there is a demand for a novel designed fishing toy by which the defects in the prior art can be improved.

SUMMARY OF THE INVENTION

Accordingly, the primary object of the present invention is to provide a fishing toy which can be installed in various aquatic animals with limbs so that as it is a hooked, the animal will preset vivid action.

In order to achieve aforesaid object, the present invention provides a fishing toy comprising a fishing tool, and a frog-shaped body. A motor capable of sinking in water is installed in the body. A battery seat, a bait biting actuation means, a swinging means; a switch which is closed by water absorption is mounted in a portion of the body for conducting energy to the motor to drive the swinging means. The swinging means is driven by a reduction gear on rotary shaft of the motor and a push plate is driven by an eccentric wheel. The fishing target is an aquatic animal or amphibian, such as a frog, with a body and four movable limbs. A front end of each limb is connected to the push plate of the swinging means. Thereby, as the fishing toy is placed on a hook of a fishing rod and in the water, the limbs of the fishing toy present a vivid action. Thus, the applications of the products are increased and the present invention can be used in many aquatic animals or amphibians.

The various objects and advantages of the present invention will be more readily understood from the following detailed description when read in conjunction with the appended drawings.

DETAILED DESCRIPTION OF THE PREFERRED EMBODIMENTS

Figure 1:
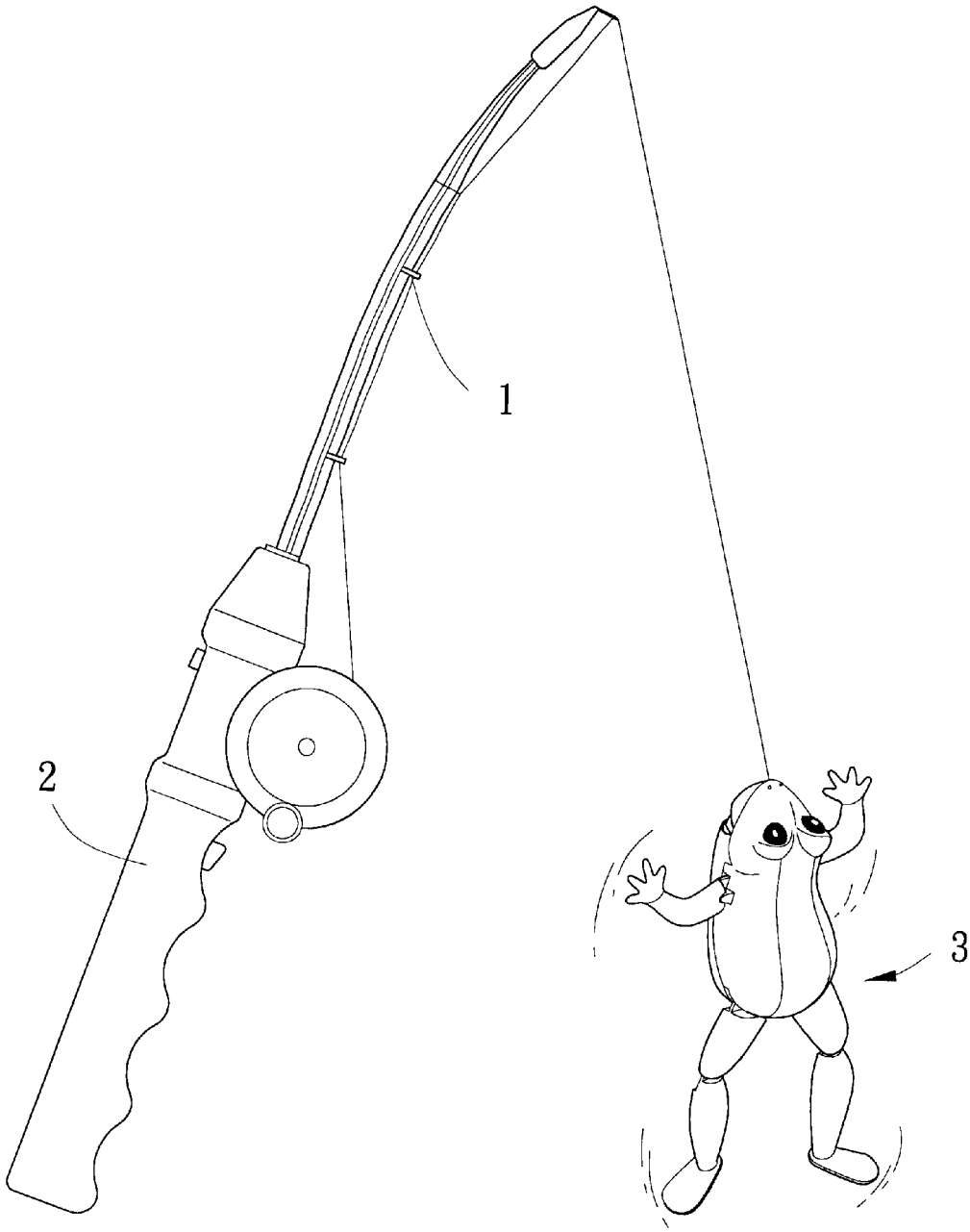
FIG. 1 is a perspective view of a fishing target in the present invention.
Figure 2:
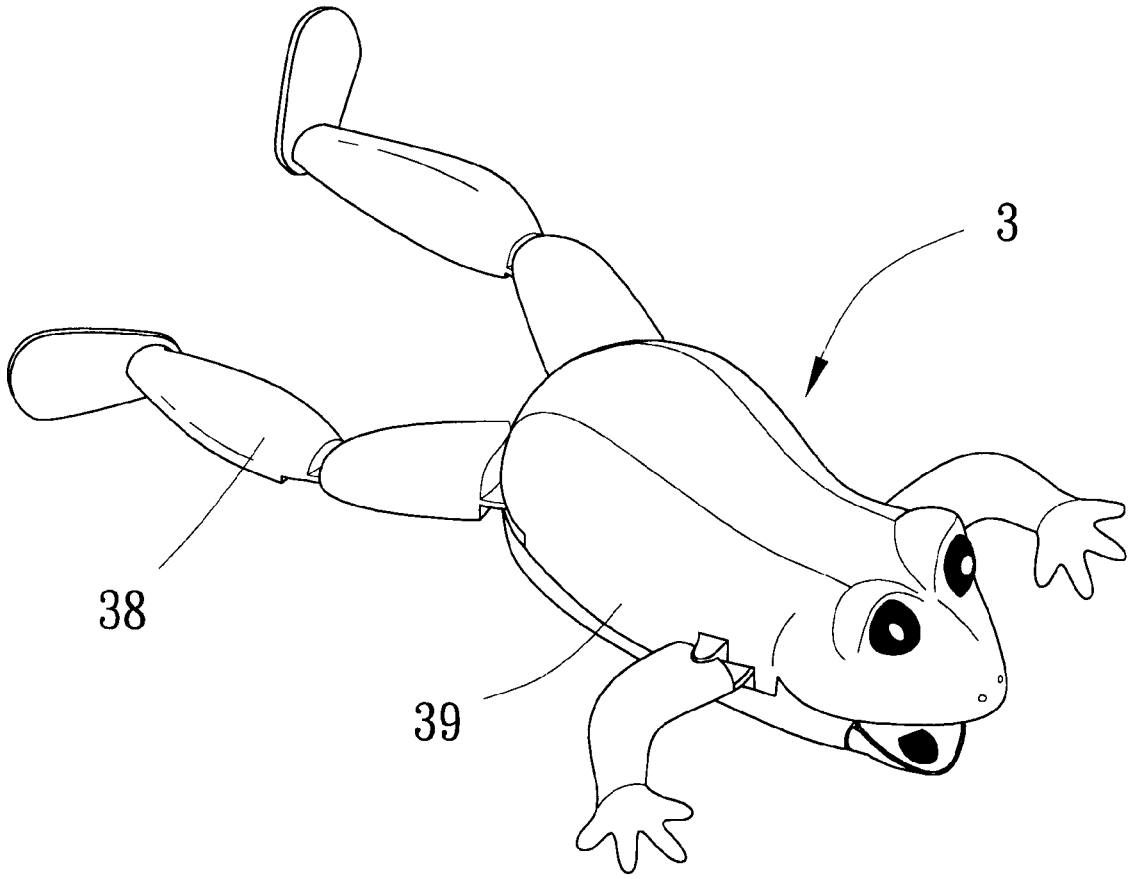
FIG. 2 is partial perspective view of the swinging means in the present invention.
Figure 3:
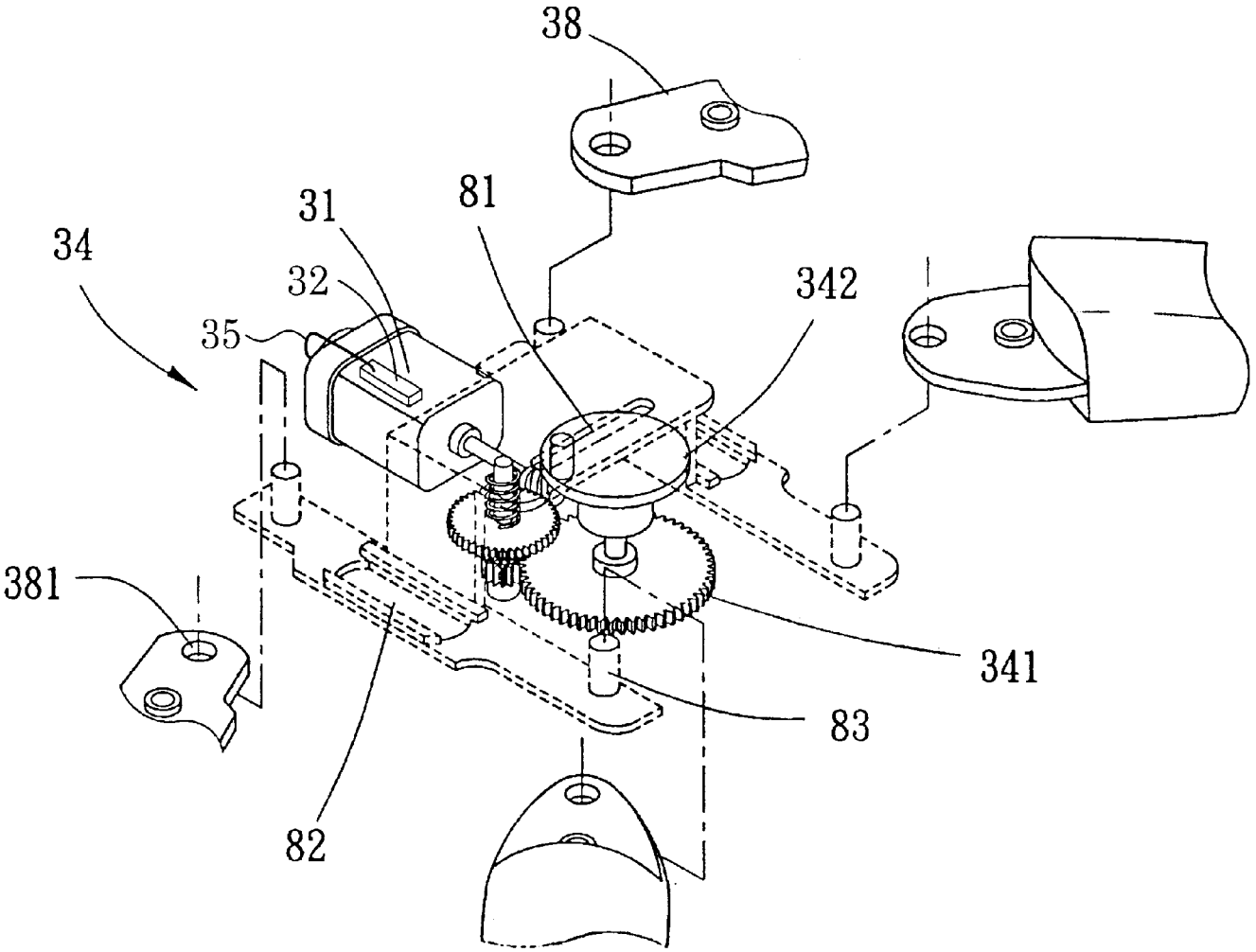
FIG. 3 is an assembled plane view in the present invention.

With reference to FIGS. 1, 2 and 3, the fishing toy according to the present invention is attached to a detachably fish rod 1, a separated handle 2, and a fishing body 3 having a shape like aquatic animals (such as fishes, shrimps, or turtles).

A sinking motor 31 (capable of being sunk in water) a battery 32 and a bait biting actuating means 33, a swinging means 34 are installed in the fishing body 3. An absorbing switch 363 is installed in the bait biting actuating means 33 for conducting electric energy from the battery 32 to the motor 31 by a conductor 35 to drive the swinging means 35 to swing.

In application, the body portion 39 and the limbs 38 are pivotally connected by posts. The distal ends of the limbs 38 are connected by posts. The distal ends of the limbs 38 are connected to long hole 381. The push plate 8 has an H shape and is arranged at the middle section of the body portion 39. The middle portion of the push plate 8 has a transversal hole 81 for being driven by the eccentric wheel 342. Two sides of the push plate 8 have longitudinal holes 83 which are placed in the guide post 391 installed in the body portion 39. Four corners of the push plate 8 each have short posts 83 which are placed in the long holes 381 of the limbs 38.

Figure 4:
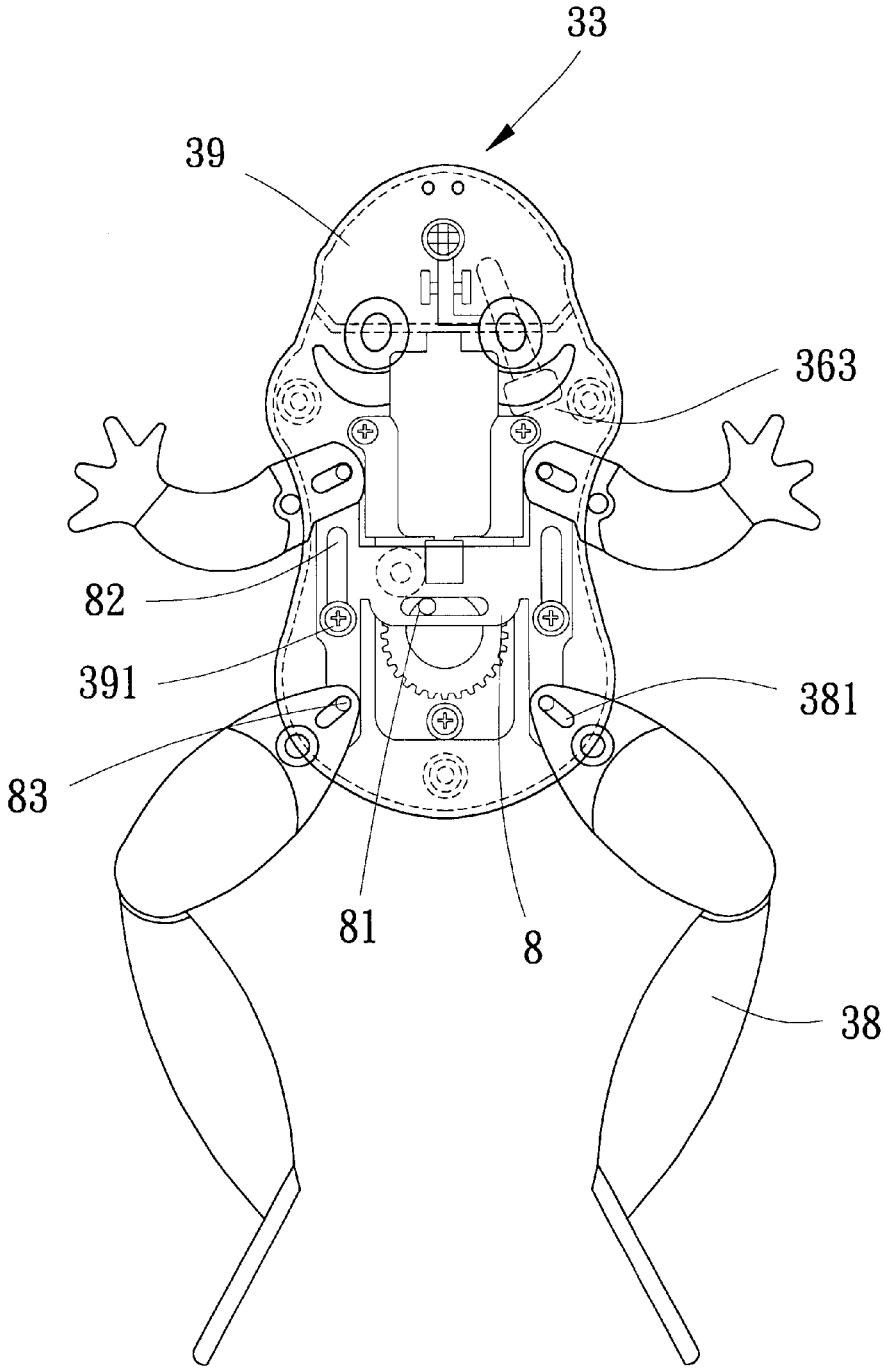
FIG. 4 is a schematic view showing the actions of the swinging means in the present invention.
Figure 5:
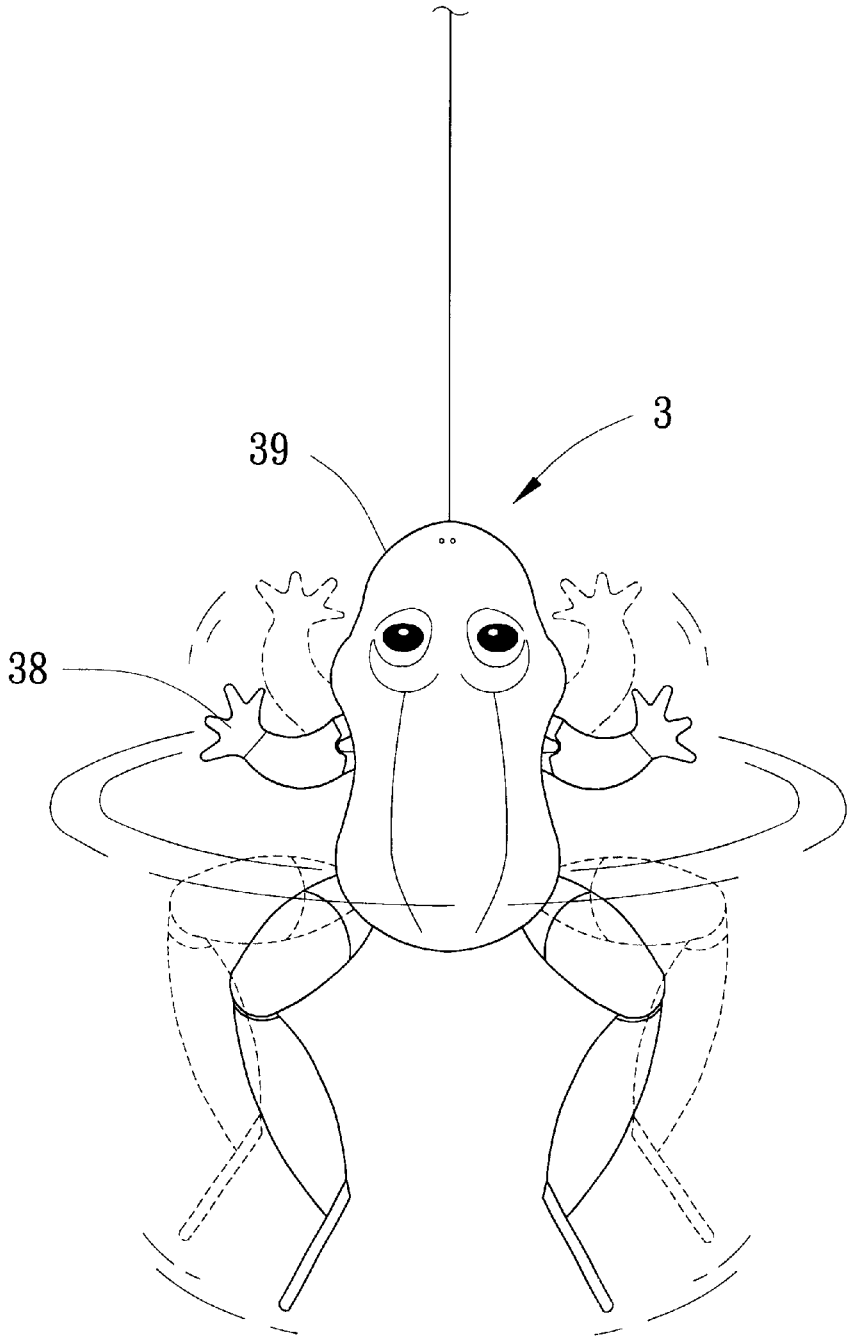
FIG. 5 is a schematic view showing that the fishing target of the present invention is hooked.

Thereby, sequentially assembling the components as shown in FIGS. 3, 4 and 5, the push plate 8 is employed to drive a limb 38. The design of the present invention has improved the limitation in the prior art, and the application of one product is expanded which is also suitable for the amphibians. As the fishing toy is used, the switch 363 within the bait biting actuation means 33 is actuated so that the motor 31 is energized to drive the swinging means 34 to swing, and the eccentric wheel 342 to drive the push plate 8 to move reciprocally, and thus the four limbs are driven to present an interesting effect. In application, the kinds of the fishing body 3 can be increased for enhancing the fun in fishing.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A fishing toy comprising:

a fishing rod including a line winding mechanism, a fishing line with one end of said fishing line wound on said line winding mechanism, a fishing target and an opposite end of said fishing line attached to said fishing target, and said fishing target comprising a toy frog with a body, a movable mouth, four pivot posts and four movable limbs each of said limbs including a first end and a first hole passing therethrough and pivotally connected to said body by one of said pivot posts extending through said first hole;

a motor capable of being emersed in water, a battery and a bait biting actuating means for moving said movable mouth, swinging means for moving said movable limbs and a movable switch triggered by absorption connecting said battery and said motor to activate said bait biting actuating means and said swinging means;

said swinging means including a reduction gear driven by said motor, an eccentric wheel including an upwardly extending pin, said eccentric wheel being driven by said reduction gear; and wherein said swinging means includes an H-shaped push plate disposed in a middle portion of said body and said H-shaped push plate including a laterally extending transverse hole formed in a middle portion thereof with said pin on said eccentric wheel extending into said transverse hole, and said push plate including four perpendicular pins with one of said pins disposed in each corner of said H-shaped push plate; and, each of said limbs including a second hole in said first end thereof inwardly of said first hole with one of said perpendicular pins extending into said second hole whereby movement of said push plate in response to the rotation of said eccentric wheel causes each of said four limbs to move with a swimming action.

* * * * *